United States Patent [19]

Dekerle

[11] Patent Number: 5,024,341

[45] Date of Patent: Jun. 18, 1991

[54] NIPPLE ADAPTER FOR A BOTTLE COMPRISING A SCREW RING

[75] Inventor: Benoit Dekerle, Evian, France

[73] Assignee: Societe Anonyme des Eaux Minerales d'Evian, Evian les Bains Cedex, France

[21] Appl. No.: 514,007

[22] Filed: Apr. 25, 1990

[30] Foreign Application Priority Data

Apr. 25, 1989 [FR] France ..... 89 05445

[51] Int. Cl.[5] ..... A61J 11/04; B65D 47/42; B65D 51/24

[52] U.S. Cl. ..... 215/11.1; 215/344

[58] Field of Search ..... 215/1 C, 11.1, 11.3–11.6, 215/343–345, 128

[56] References Cited

U.S. PATENT DOCUMENTS

| | | | |
|---|---|---|---|
| 1,672,467 | 6/1928 | Oshman et al. | 215/11.1 |
| 2,771,073 | 11/1956 | Mills | 215/11.1 |
| 2,882,947 | 4/1959 | Close | 215/1 C X |
| 3,072,272 | 1/1963 | Doner | 215/11.1 |
| 3,323,669 | 6/1967 | Yazaki | 215/11.1 |
| 3,401,813 | 9/1968 | Sherwood | 215/11.6 |
| 3,586,196 | 6/1971 | Barton et al. | 215/344 X |
| 3,747,791 | 7/1973 | Fouser | 215/11.1 |
| 3,888,373 | 6/1975 | Gach et al. | 215/344 X |
| 4,387,819 | 6/1983 | Corsette | 215/344 X |
| 4,711,365 | 12/1987 | Fomby | 215/344 X |

FOREIGN PATENT DOCUMENTS

| | | | |
|---|---|---|---|
| 84970 | 8/1921 | Austria | 215/11.1 |
| 322837 | 7/1920 | Fed. Rep. of Germany | 215/11.1 |
| 2499518 | 8/1982 | France . | |
| 2583387 | 12/1986 | France | 215/11.6 |
| 2029379 | 3/1980 | United Kingdom | 215/11.1 |

*Primary Examiner*—Sue A. Weaver
*Attorney, Agent, or Firm*—Herbert Dubno

[57] ABSTRACT

A nipple end-piece adapter is disclosed for a bottle having a threaded neck, and further comprising an inner threaded chimney adapted for cooperating with the thread of the neck of the bottle, a sidewall also threaded for receiving the ring of the end-piece and, in addition, a skirt connected to the chimney, shaped and positioned so that it cooperates sealingly with the internal face of the neck of the bottle when the adapter is fixed thereon by screwing its chimney on the neck.

3 Claims, 2 Drawing Sheets

NIPPLE ADAPTER FOR A BOTTLE COMPRISING A SCREW RING

FIELD OF THE INVENTION

The invention relates to a teat adapter for a bottle having an outer threaded neck.

BACKGROUND OF THE INVENTION

Mineral water has been used for a long time for preparing drinks in feeding bottles for infants, which generally comprise a nipple removably fixed to a bottle with a wide neck by means of a threaded ring adapted to be screwed on to said neck. The ring and the nipple after being fitted on the bottle form a liquid tight end-piece which allows air to enter the feeding bottle, progressively as the infant sucks. The bottles and the threaded end-pieces are sterilized before the feeding bottles are filled, including those to be filled with mineral water which are frequently given to a young child during walks, journeys or similar outings. It is then necessary, during such outings, to take one or more sterilized nipple bottles and the mineral water bottles for filling them. The weight and space required, particularly for a young mother, may then be a hindrance.

OBJECT OF THE INVENTION

It is precisely an object of the invention to provide a device overcoming, this drawback.

SUMMARY OF THE INVENTION

In this respect, an object of the invention is to take advantage of the fact that mineral water can now be found on the market packed, in the factory and with all guarantees of hygiene, in bottles comprising an outer threaded ring, even though these bottles comprise, during manufacture, necks having a threaded portion of given diameter, different from that of the threaded portions of the usual threaded end-pieces sold commerically.

Consequently, an object of the invention is to provide an adapter for simply and reliably associating a usual threaded end-piece with bottle comprising a threaded neck, in particular a mineral water bottle made from plastic material.

A threaded end-piece adapter according to the invention, for a bottle comprising an outer threaded neck is then characterized by the fact that it has an inner threaded chimney adapted for cooperating with the threaded neck of the bottle, an external sidewall also threaded for receiving the end-piece and, in addition, a skirt connected to the chimney, shaped and positioned so that it cooperates sealingly with the internal face of the ring of the bottle when the adapter is fixed thereon by screwing its chimney on said ring.

In a preferred embodiment of the invention, the adapter is made from plastic material, such as polyethylene, advantageously molded in one place by injection so as to form at the inner end of the skirt a multiplicity of spokes which are then sectioned (i.e. cut).

The chimney is advantageously connected to the skirt by a flat annular portion.

In a preferred embodiment, the diameter of the inner threaded chimney is about 26 to 28 mm and the diameter of the external threaded sidewall about 43 mm.

BRIEF DESCRIPTION OF THE DRAWING

The invention will be well understood from the following description, given by way of example, with reference to the accompanying drawings in which.

DESCRIPTION OF THE PREFERRED EMBODIMENTS

Figure 1:
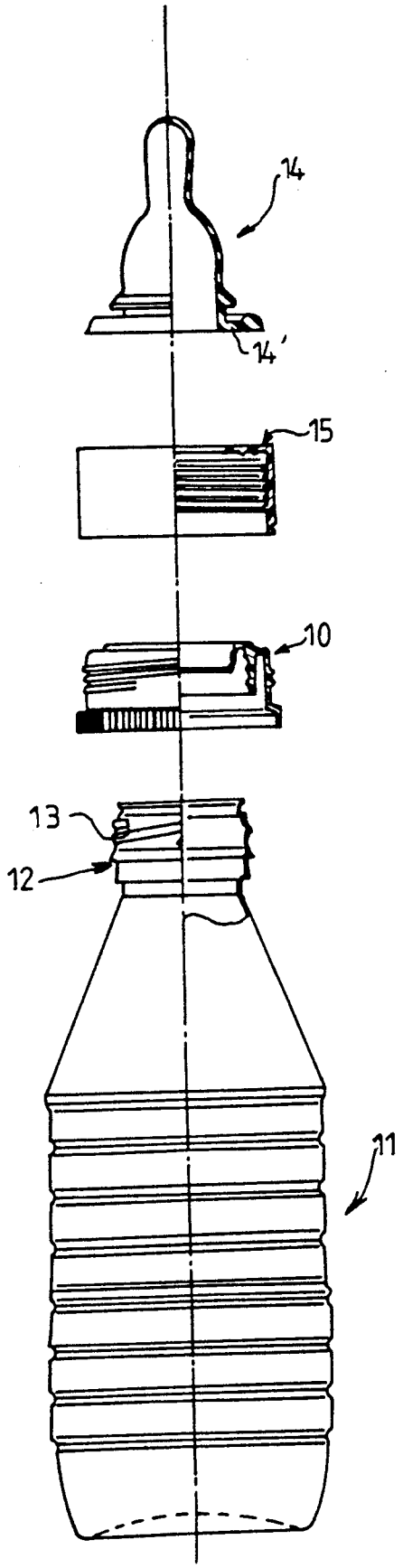
FIG. 1 is an exploded view, half in section and half in elevation, of a bottle of mineral water comprising an outer threaded neck with which is associated an adapter according to the invention and a threaded end-piece device.

A threaded end-piece adapter 10, according to the invention, is intended to equip a bottle 11 whose neck 12 comprises a thread 13.

Bottle 11 may, without this indication having any limitative character, be a glass bottle or a plastic material bottle, advantageously made from PVC, containing from 33 to 50 cl and which is filled with natural mineral water in the bottling factory.

For bottles of this type, neck 12 with which a screw cap, not shown, cooperates for sealing closing same, has a diameter which is about 26–28 mm so that it cannot directly receive a usual threaded nipple end-piece sold commerically.

It is in order to permit fitting of such an end-piece, formed by a nipple 14 with collar 14' and threaded ring 15, that the invention provides the adapter 10.

Figure 3:
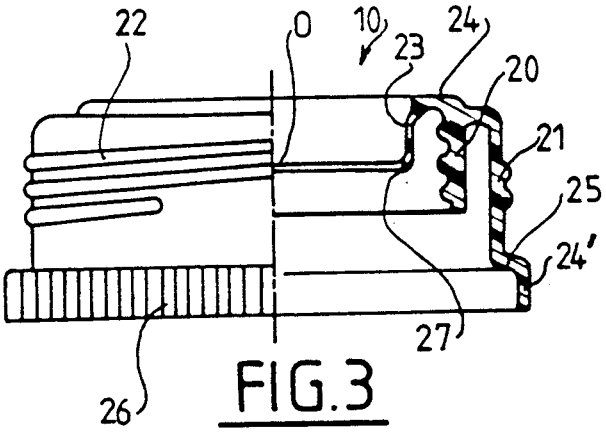
FIG. 3 is a view half in section and half in elevation, on a larger scale, of an adapter according to the invention.

As can be seen in FIG. 3, it has an inner chimney 20 adapter for cooperating with thread 13 of the neck of bottle 11, an external sidewall 21 with thread 22 for receiving ring 15 of the threaded end-piece and a substantially cylindrical skirt 23 of a smaller diameter than chimney 20 to which it is connected by a flat annular portion 24. The free end of the external sidewall 21 is formed, following a shoulder 25, as a short sleeve 24', engine turned on its external face, as shown at 26, so as to facilitate actuation thereof.

In a preferred embodiment, an adapter 10 is molded in a single piece from plastic material, such as polyethylene and preferably by injection from center 0 of the circle defined by the free end 27 of skirt 23 so as to form first of all a multiplicity of spokes which are then sectioned from the adapter itself.

Figures 2, 2A:
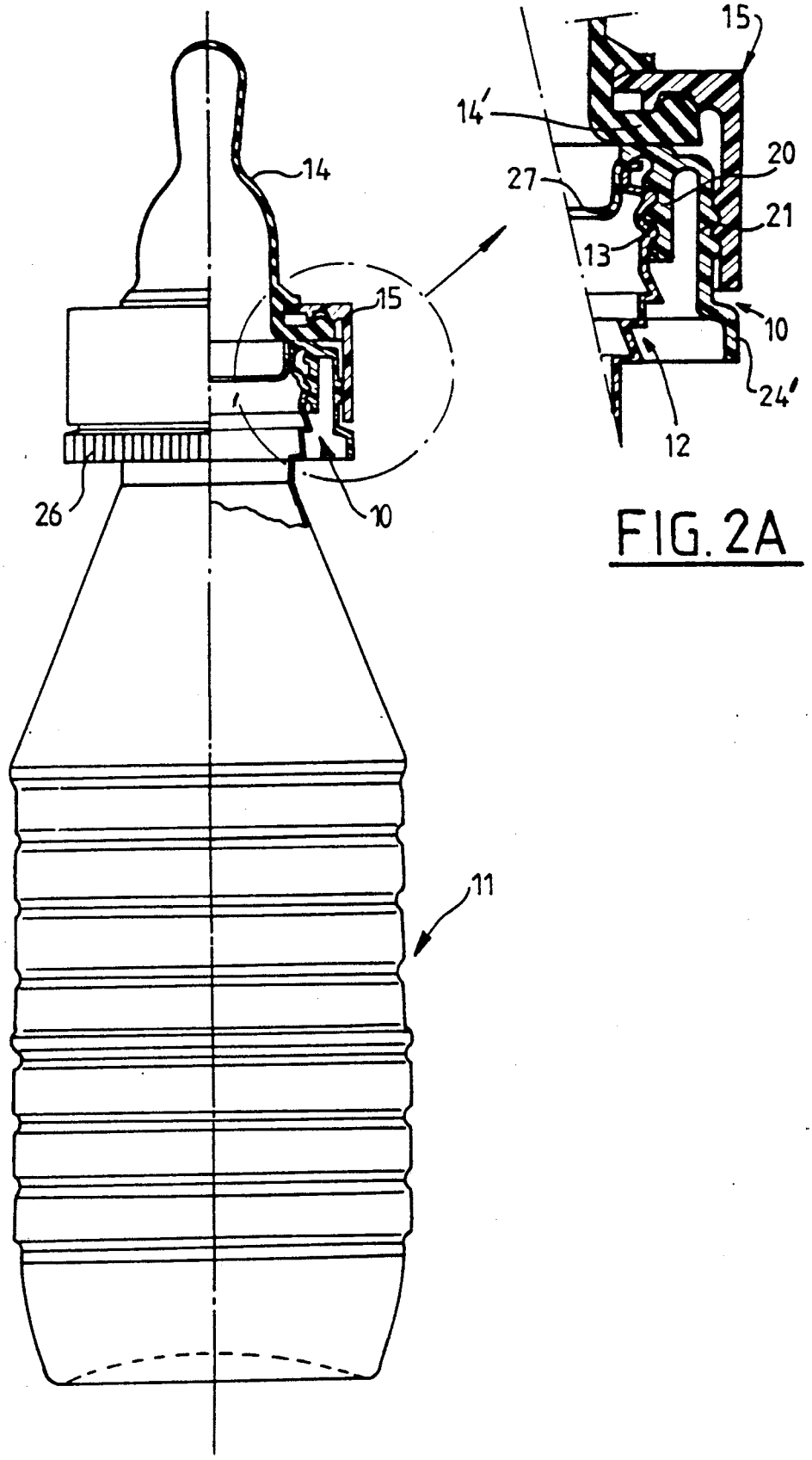
FIG. 2 is a view, half in section, half in elevation, similar to that of FIG. 1, but showing the assembled elements.
FIG. 2A is a partial view, on a larger scale, of a portion of FIG. 2.

The method of using the latter is immediately clear from the foregoing. After removing the screw cap from bottle 11, the latter is fitted with adapter 10 by screwing chimney 20 which it comprises on thread 13, which simultaneously sealing applies skirt 23 against the internal face of neck 12 of the bottle, taking into consideration the dimensions and positioning of said skirt, FIG. 2A. When the nipple end-piece is then fitted to the adapter, by screwing ring 15 on the external sidewall 21 with screw thread 22, a feeding bottle of natural mineral water is very simple obtained, ready to be given to an infant.

The result is obtained by using the usual threaded end-pieces found in commerce, namely end-pieces whose ring 15 has a diameter of about 43 mm, and that simply and reliably, without it being necessary to apply an appreciable tightening torque for sealing the end-piece on the bottle, without having to use an added seal and without altering the operation of the nipple which, although water-tight, nevertheless allows air to enter the feeding bottle progressively as the infant sucks.

Adapter 10 may be used and re-used numerous times without having to take other precautions than that of keeping it clean.

What is claimed is:

1. An adapter for adapting a nipple end-piece having an internally threaded ring onto a bottle having an outer threaded neck, said adapter comprising an outer threaded sidewall for receiving said internally threaded ring of the endpiece, an internally threaded chimney within said sidewall adapted for cooperating with said neck of the bottle, and a skirt within said chimney and connected to said chimney, shaped and positioned so that it cooperates sealingly with an internal face of the neck of the bottle when the adapter is fixed thereon by screwing its chimney onto said neck of the bottle.

2. The adapter as claimed in claim 1 wherein said chimney is connected to said skirt by a substantially flat annular portion.

3. The adapter as claimed in claim 1 wherein the diameter of said inner threaded chimney is about 26 to 28 mm and the diameter of the external threaded sidewall about 43 mm.

* * * * *